United States Patent [19]

Sharples et al.

[11] Patent Number: 4,670,004

[45] Date of Patent: Jun. 2, 1987

[54] SWINGING BUCKET ROTOR HAVING IMPROVED BUCKET SEATING ARRANGEMENT

[75] Inventors: Thomas D. Sharples, Atherton; Alireza Piramoon, Santa Clara, both of Calif.

[73] Assignee: Beckman Instruments, Inc., Fullerton, Calif.

[21] Appl. No.: 808,406

[22] Filed: Dec. 11, 1985

[51] Int. Cl.[4] ..... B04B 5/02

[52] U.S. Cl. ..... 494/20; 494/16

[58] Field of Search ..... 494/20, 16

[56] References Cited

U.S. PATENT DOCUMENTS 4,193,536 3/1980 Kubota ..... 494/16 X 4,226,669 10/1980 Vilardi ..... 494/16 X 4,342,419 8/1982 Conway ..... 494/20 X 4,435,168 3/1984 Kennedy ..... 494/20

*Primary Examiner*—Timothy F. Simone

*Attorney, Agent, or Firm*—W. H. May; P. R. Harder

[57] ABSTRACT

A swinging bucket centrifuge rotor including seating surfaces having shapes which cause buckets seating thereon to be relieved of side loading forces. Each bucket is symmetrical and is pivotally supported by bucket pins that rest in respective spring-loaded carrier assemblies. The spring constants of the springs of the carrier assemblies are selected so that the leading edge of each bucket bottom rests upon a curved surface and clears the respective seating surface before the trailing edge thereof contacts the same. The resulting bucket orientation assures that, upon seating, each bucket rotates until its bucket pins lift slightly off of the surfaces of the respective carrier assemblies.

13 Claims, 10 Drawing Figures

FIG. 1
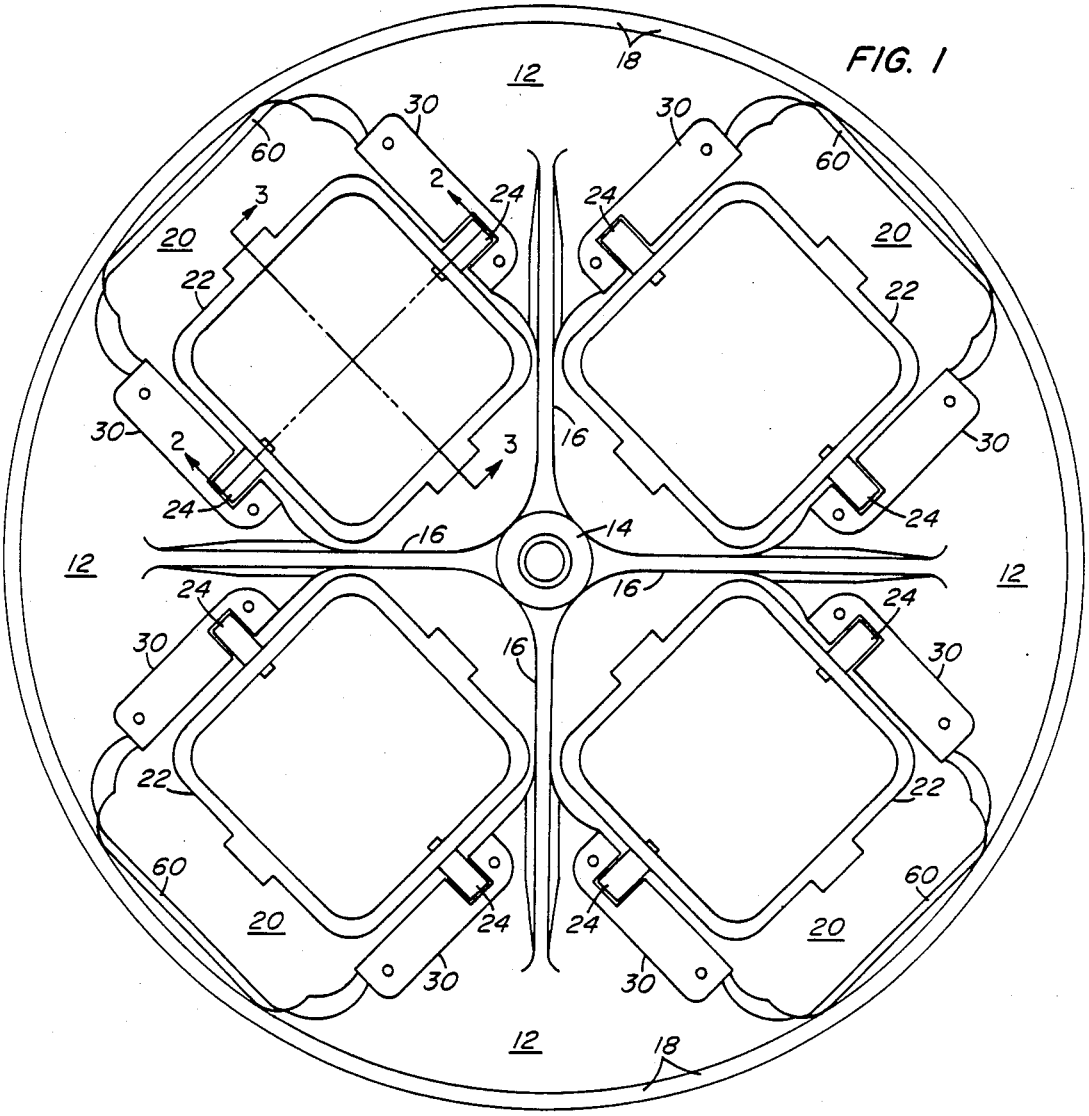
FIG. 2
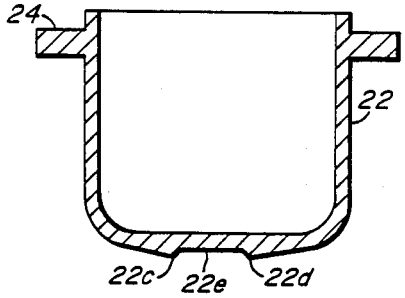
FIG. 3
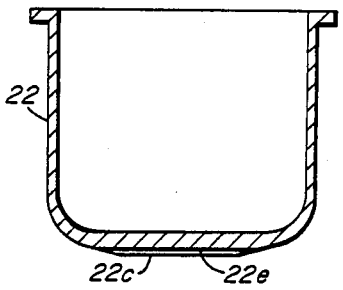
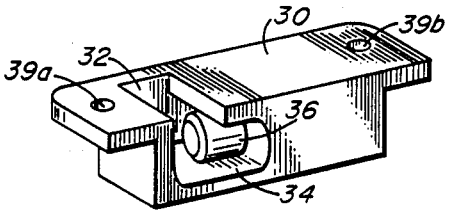
FIG. 4

PRIOR ART

SWINGING BUCKET ROTOR HAVING IMPROVED BUCKET SEATING ARRANGEMENT

BACKGROUND OF THE INVENTION

The present invention relates to swinging bucket rotors for centrifuges, and is directed more particularly to a swinging bucket rotor having an improved bucket seating arrangement.

Under circumstances in which relatively large sample vessels or relatively large numbers of small sample vessels are to be centrifuged, it is a common practice to use centrifuges having swinging bucket rotors. Rotors of the latter type include a plurality of symmetrically located openings in which a plurality of buckets are hung by respective pairs of bucket pins. When the rotor is stationary, these buckets assume a substantially vertical position for easy loading. As the rotor is accelerated, however, the bottoms of the buckets swing outwardly until they come into contact with a seating surface on the periphery of the rotor. This seating surface provides radial support to the buckets and thereby prevents large radial loading forces from being applied to the bucket pins.

In rotors of the above type, the bucket pins are ordinarily mounted in spring-loaded carrier assemblies. When the rotor is stationary, or is rotating only slowly, these assemblies serve to hold the buckets close enough to the center of the rotor that they can swing freely without contacting the seating surface. When the rotor is rotating at a high speed, however, these assemblies allow the buckets to move outwardly from the center of the rotor and to seat on their respective seating surfaces. Thus, the spring-loaded carrier assemblies assure that the buckets pivot freely and yet seat securely.

One important objective in the design of a swinging bucket rotor is that each bucket seat in a position in which little or no side loading forces act on its bucket pins, i.e., no forces which act in a direction parallel to the rotational axis of the rotor. This, in turn, makes it desirable to assure that, as each bucket seats, its pins tend to lift slightly off of the surfaces of the respective carrier assemblies. This lift-off is desirable because it assures that the pins of the bucket are not in contact with any surface that is capable of generating side loading forces.

One serious problem with swinging bucket rotors is that the desired seating condition may not be established if the buckets are loaded unevenly, i.e., so that they do not rest vertically when the rotor is stationary. This is because the uneven loading of a bucket changes the angle at which the bottom of that bucket first comes into contact with the seating surface. If, for example, the angle is such that the outer or leading edge of the bucket contacts the seating surface before the inner or trailing edge thereof, the friction between the leading edge and the seating surface can prevent the bucket from swinging into the desired seated position. If this occurs, the continued acceleration of the rotor will produce a moment which generates substantial side loading forces in the bucket pins. While these side loading forces may not be sufficient to cause the bucket pin to fail immediately, they can be sufficient to produce fatigue which will eventually cause the bucket pin to fail.

Prior to the present invention, the above-described seating problem was dealt with by locating the bucket pins above the center line of the bucket. This off-center location tended to assure that the trailing edge of the bucket contacted the seating surface prior to the leading edge thereof. The latter contact sequence, in turn, assured that, as the bucket seated, it tended to rotate slightly in a direction which caused the bucket pins to lift off of their carrier assemblies and thereby be relieved of any side loading forces.

While the use of off-center bucket pins tended to solve the bucket seating problem, it also introduced a non-symmetry into the structure of the bucket. This non-symmetry not only increased the cost of the bucket, but also created the risk that an inattentive operator could insert the bucket with a reversed orientation, i.e., with an orientation 180° from its intended orientation. If such a reversal did occur, it tended to aggravate rather than lessen the original seating problem. Under such conditions, the moment developed by the reversed bucket could cause extremely large side loading forces to develop in the bucket pins and thereby initiate a catastrophic failure. Thus, the solution which the prior art provided for the bucket seating problem was both costly and potentially dangerous.

The existing art contemplates a sloped seating surface, i.e., one which is slightly inclined with respect to the axis of the rotor. The existing art contemplates the use of carrier assembly springs which have a stiffness that allows the leading edges of the bucket bottoms to clear the seating surfaces before the trailing leading edges thereof come into contact therewith. As the buckets seat, they rotate in directions which raise their bucket pins slightly off of the surfaces of the respective carrier assemblies and thereby prevent side loading forces from being applied thereto.

SUMMARY OF THE INVENTION

In accordance with the present invention, there is provided a swinging bucket rotor having an improved seating arrangement which solves the above-described bucket seating problem without requiring the use of unsymmetrical buckets.

Generally speaking, the present invention contemplates a swinging bucket rotor, having symmetrical buckets, in which the configuration of the seating surface and the strength of the springs of the carrier assemblies cooperate to assure that the trailing edge of the bucket contacts the seating surface before the leading edge thereof. This, in turn, assures that the centrifugal weight of the bucket acts at a point that lies above the point at which the bucket bottom first contacts the seating surface. As a result, as the bucket seats, it rotates through a small angle, causing the bucket pins to lift slightly off of the surfaces of the respective carrier assemblies. In this manner the rotor of the invention prevents side loading forces from being applied to the bucket pins, substantially without regard to any initial imbalance in the loading of the buckets.

In the preferred embodiment, the invention contemplates a seating surface which includes an equatorial section of a prolate ellipsoid having a major axis which is aligned with the axis of the rotor, together with a bucket having an at least partially spheroidal bottom with a generally similar curvature. Together with a carrier assembly springs having the above-discused stiffness, this seating surface establishes a single, unique seated position for the bucket, substantially without regard to any initial imbalance therein. Advantageously, as this seated position is established, the bucket pins are raised slightly above the surfaces of the respective carrier assemblies, thereby preventing side loading forces from being applied to the bucket pins.

DESCRIPTION OF THE DRAWINGS

Other objects and advantages of the invention will be apparent from the following description and drawings in which:

FIG. 1 is a plan view of a swinging bucket rotor assembly which includes the seating arrangement of the invention;

FIG. 2 is a cross-sectional view of a bucket taken along the line 2—2 of FIG. 1;

FIG. 3 is a cross-sectional view of a bucket taken along the line 3—3 of FIG. 1;

FIG. 4 is a perspective view of one of the bucket pin carrier assemblies of FIG. 1;

DESCRIPTION OF THE PREFERRED EMBODIMENT

Figure 5A:
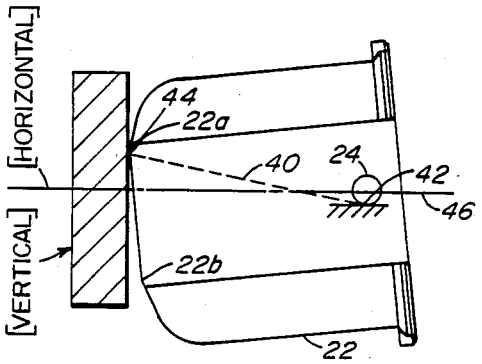
FIG. 5A PRIOR ART
FIG. 5A shows a bucket engaging a seating surface of a type known in the art.

Referring to FIG. 1 there is shown a plan view of a swinging bucket rotor assembly which incorporates one embodiment of the existing art and the preferred embodiment. This assembly includes a forged one-piece rotor having a plurality of webs 12 which are connected to a central drive spool 14 by respective spokes 16. The outer periphery of this rotor is occupied by a generally cylindrical carrier ring 18 which is integral with webs 12. Together with spokes 16, and webs 12, ring 18 defines a plurality of bucket openings 20 in which a plurality of swinging buckets 22 are pivotally supported by respective pairs of bucket pins 24.

In the existing and and the preferred embodiment, each bucket is symmetrical in that it has two vertical planes of symmetry. One of these planes of symmetry passes through the center of the bucket pins and is generally perpendicular to a radius of the rotor. The inner and outer profiles of a bucket along this plane of symmetry is shown in FIG. 2. The second of these planes of symmetry bisects the bucket and is generally aligned with a radius of the rotor. The inner and outer profiles of a bucket along this plane of symmetry is shown in FIG. 3. Because of these symmetry features, each bucket (when empty) assumes a substantially vertical orientation within the respective bucket openings and distributes its weight approximately equally between its bucket pins.

To the end that the buckets may swing outwardly as the rotor accelerates, the rotor assembly of FIG. 1 includes a plurality of carrier assemblies 30 for providing pivotal support to the bucket pins of respective buckets. Each of these carrier assemblies is secured to one edge of a web and receives one bucket pin of the respective bucket. A representative one of these carrier assemblies is shown in greater detail in FIG. 4.

Referring to FIG. 4, it will be seen that carrier assembly 30 includes a vertical opening 32 which connects to a horizontal opening 34 that serves as a retaining slot for a bucket pin. Assembly 30 also includes a spring-loaded pin 36 which is urged forwardly, i.e., toward the inner end of slot 34, by a spring (not shown) which is located between pin 36 and the rear wall of assembly 30. The entire assembly is secured to one edge of a respective web by suitable bolts or rivets which pass through a pair of mounting holes 39*a* and 39*b*.

When the rotor is stationary, the buckets have the substantially vertical orientation shown in FIG. 1. Under this condition, spring-loaded pin 36 forces the respective bucket pin toward inner end of slot 34, which end has a curvature similar to that of the pin. As the rotor accelerates, however, the buckets pivot within slot 34 as their bottoms move outwardly and upwardly toward ring 18. At the same time, the radial force that acts on the bucket as a result of the rotation of the rotor (hereinafter referred to as the centrifugal weight of the bucket) tends to cause the bucket pins to move toward the outer end of slot 34, against the inward force applied by spring-loaded pin 36. As this movement continues, the buckets become more and more nearly horizontal, until their bottoms eventually come to rest against the inner surface of ring 18. In order to prevent the application of excessive radial loading forces to the bucket pins, each bucket is preferably firmly seated on ring 18 before its bucket pins force pin 36 to the extreme outer end of slot 34. This is because the firm seating of the bucket on the ring allows the ring rather than the pins to support the centrifugal weight of the bucket.

Prior to the present invention, an imbalance in the loading of a bucket often caused that bucket to come into contact with he carrier ring 18 with the orientation shown in FIG. 5A. With this orientation, the line 40 joining the point 42 of contact between the bucket pin and the carrier assembly, and the point of contact between the bottom of the bucket and the carrier ring will lie above the horizontal plane through point 42. As a result, the forces which act on the bucket at the instant of contact will be as shown in the free body diagram of FIG. 5B, in which the bucket is represented by a liner member 40 that has contact points corresponding to those shown in FIG. 5A.

Figure 5B:
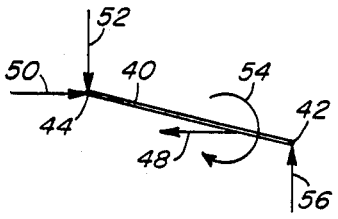
FIG. 5B PRIOR ART
FIG. 5B is a simplified free body diagram showing the forces acting on the bucket of FIG. 5A.

Referring to FIG. 5B, it will be seen that member 40 is acted upon by a number of different forces. Among these are a radially directed force 48 which represents the centrifugal weight of the bucket, a force 50 which represents the inward force produced by the carrier ring, and a force 52 which represents the force produced by friction between the bucket and the carrier ring. Because the latter forces do not include a vertically directed force which balances frictional force 52, they generate a moment of force 54 which tends to rotate member 40 in a clockwise direction. As a result, unless the bucket slips, there must arise a vertically directed force 56 (hereinafter referred to as a side loading force) which acts at point 42. Because this force tends to bend the bucket pins toward one side of the bucket, it is often referred to as a side loading force. In high speed centrifuges this force can be strong enough to cause fatigue in or even failure of the bucket pin. It will therefore be seen that swinging bucket rotors which utilize the prior art bucket and seating arrangement shown in FIG. 5A are subject to destructive side loading forces.

Figure 6A:
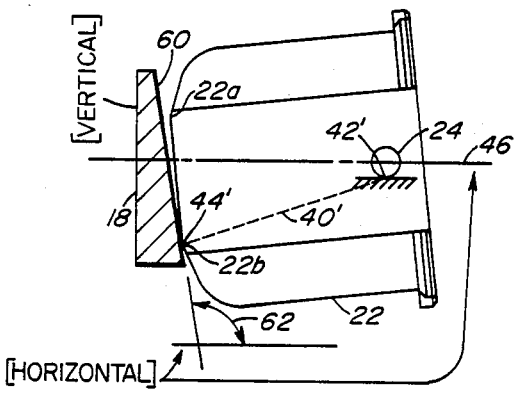
FIG. 6A PRIOR ART
FIG. 6A shows a bucket engaging a seating surface of the type contemplated by the existing art.

In accordance with another form of the existing art, the above-described side loading is eliminated, without using buckets having off-center bucket pins, by providing a rotor which includes a sloped planar seating surface of the type shown in cross-section in FIG. 6A. This embodiment of the existing art is representative of the approach to the problems which the inventive embodiment of FIGS. 7 and 8 attempt to solve. Specifically, the embodiment of FIG. 6A includes a carrier ring 18 having a sloped planar seating surface 60 the center line of which forms an angle slightly greater than 90° with the plane 46 defined by the centers of the bucket pins. In FIG. 6A this angle is labeled 62 and is approximately equal to 91 degrees 30 minutes ±15 minutes. Alternatively, if the angle is measured with respect to the axis of the rotor, the angle of the surface will be approximately 1 degree 30 minutes ±15 minutes. Because of its planar surface and slight slope, seating surface 60 appears as the two closely spaced parallel lines which appear at the outer end of each bucket opening of the rotor of FIG. 1.

Because of the slope of seating surface 60 of FIG. 6A, trailing edge **22*b* of bucket 22 will contact the carrier ring prior to leading edge 22*a* thereof, even though it has exactly the same orientation as the bucket of FIG. 5A. Given this orientation, the line 40' which joins the point 42' of contact between the bucket pin and the carrier assembly, and the point 44' of contact between the bottom of the bucket and the carrier ring will lie below the horizontal plane through point 42'. As a result, the forces which act on the bucket at the instant of contact will be as shown in the free body diagram of FIG. 6B, in which the bucket is replaced by a linear member 40'** that has contact points corresponding to those shown in FIG. 6A.

Figure 6B:
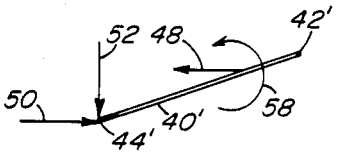
FIG. 6B is a simplified free body diagram showing the forces acting on the bucket of FIG. 6A.

In FIG. 6B, the force 48 representing the centrifugal weight of the bucket, the force 50 representing the inward force produced by the carrier ring, and the force 52 which represents the force produced by the friction between the bucket and the carrier ring are generally similar to those shown in FIG. 5B. Because of the diferent slope of the seating surface, however, centrifugal weight 48 acts above rather than below inward force 50. Under these conditions, forces 48, 50 and 52 generate a counterclockwise moment 58 which will cause bucket 22 to rotate in a counterclockwise direction until its bottom becomes solidly seated on seating surface 60. As this occurs, the bucket pins are lifted slightly off of their former supporting surfaces within their carrier assemblies. It will therefore be seen that sloped seating surface 60 of FIG. 6A causes the bucket to be firmly seated in an orientation in which no side loading forces act upon its bucket pins.

Significantly, the above-described result will occur, substantially without regard to any initial imbalance in the loading of the buckets, provided only that the stiffness or spring constant of the springs used in the carrier assemblies allows the leading edge of the bucket bottom to clear the carrier ring prior to the time that the trailing edge establishes contact therewith. The numerical value of the spring constant necessary to assure this result will naturally depend upon the weight and dimensions of the bucket, the location of the bucket pins, the radius of the carrier ring, and the coefficient of friction of the contact between the bucket pin and its carrier assembly. Once these parameters are fixed, however, the calculations necessary to determine the required spring constant are of a type that are known to those skilled in the art. Accordingly, the nature of this calculation will not be discussed in detail herein.

As stated earlier, the embodiment of FIG. 1 has a seating surface that is generic to the existing art and the preferred embodiment. This planar surface was desirable because it establishes a solid distributed contact with the surface defined by the two parallel straight edges that are located at the bottom of bucket 22. These edges, which are labeled **22*c* and 22*d* in FIGS. 2 and 3, are located at the intersection between a basal groove 22*e*** and the otherwise generally spheroidal bottom of the bucket. The surface defined by these edges also serves to prevent the bucket from rocking when it is resting on a surface outside of the centrifuge.

The present invention may also be practiced by using a sloping seating surface having a generally conical shape. Such a seating surface may be produced by a straight-edged milling cutter which has an axis that forms a small angle with the axis of the rotor, and which is held stationary while the rotor is rotated about its axis. Equivalently, such a seating surface may be produced by a similarly oriented cutter which is rotated along a circular arc centered on the axis of the rotor while the rotor is held stationary. Because of the manner in which it is produced, the resulting conical seating surface may be regarded as a surface of revolution generated by the rotation of a sloping line segment about the axis of the rotor. If a conical seating surface is used, a bucket having the shape shown in FIGS. 2 and 3 will come to rest on three of its corners, rather than on its two parallel edges.

Figure 7:
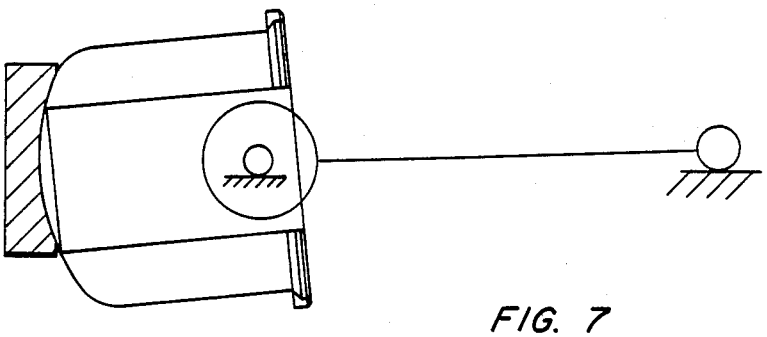
FIG. 7 shows a bucket engaging a seating surface of a type contemplated by the preferred embodiment of the present invention.

Rotors having seating surfaces of revolution comprise preferred embodiments of the invention. A surface of revolution generated by the revolution about the axis of the rotor of an equatorial section of an ellipse having a major axis that lies along the axis of the rotor, for example, provides a highly desirable seating surface. This is because, when the resulting ellipsoidal seating surface is used with a bucket, such as that shown in FIGS. 2 and 3, which has an at least partially spheroidal bottom, it results in a single predetermined bucket seating position, substantially without regard to any initial bucket loading imbalance. Accordingly, provided that the curvatures of the ellipsoidal seating surface and the bucket are such that the bucket pins lift slightly off of the surfaces of the respective pin assemblies upon seating, even poorly balanced buckets will assume the desired optimal seating positions. FIG. 7 shows a cross-sectional view of a rotor which has such an ellipsoidal seating surface, togther with a bucket which has the desired final seating orientation.

Figure 8:
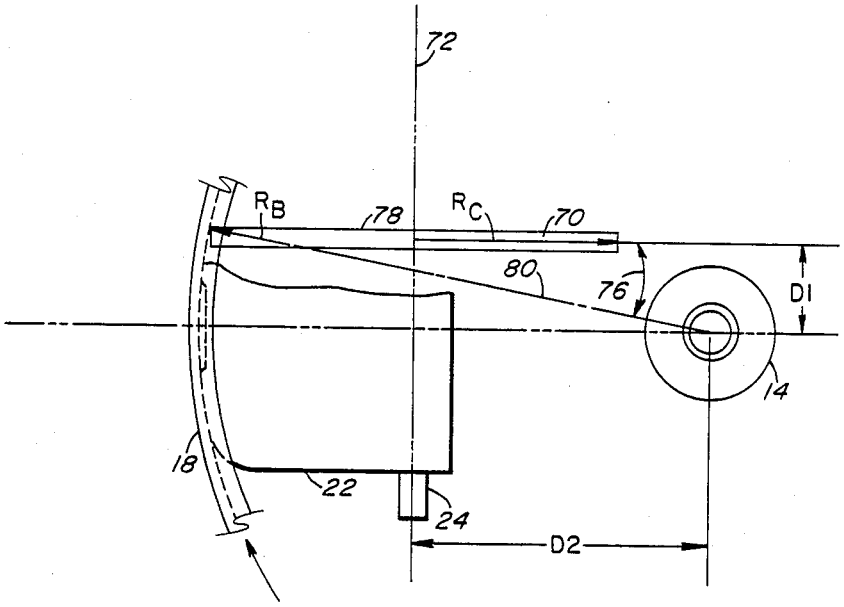
FIG. 8 is a conceptualized partial plan view which illustrates the relationships which are employed in the machining of the seating surface of FIG. 7.

The true curvature of the ellipsoidal surface which is shown in cross-section which is shown in FIG. 7 is most easily understood with reference to FIG. 8. The latter Figure comprises a simplified fragmentary version of FIG. 1 which shows a hypothetical machining arrangement that would produce the desired ellipsoidal surface. Referring to FIG. 8, there is shown a circular straight edged milling cutter 70 having an axis of rotation that is perpendicular to the axis of the rotor. While no bucket is actually present while rotor 18 is being machined, a part of a bucket is nevertheless shown in FIG. 8 in order to clarify the starting position of the cutter in relation to the desired seated position of that bucket.

In FIG. 8 the radius of cutter 70 and its starting position are selected to meet three criteria. The first of these is that radius $R_c$ of the cutter be substantially equal to the distance between the line joining the centers of the bucket pins and the edge of the surface on which the bucket is to seat. The second criterion is that the center of cutter 70 be offset from the center of the rotor by a distance D1 that is approximately equal to one half of the width of the bucket. Together, the meeting of the first and second criteria assures that the sides and corners of the bucket do not contact the web as the bucket swings into the desired seated position. The final criterion is that the axis of cutter 70 be offset from the center of the rotor by a distance D2 which corresponds to the desired position of the line through the centers of the bucket pins when the bucket is seated on ring 18. The meeting of this criterion assures that the bucket seats while its pins are located at the desired distances from the center of the rotor and therefore at the desired distances from the outer ends of the slots of the respective carrier assemblies.

During machining, the rotor is preferably rotated past cutter 70, causing the edge thereof to follow a circular path having a radius of curvature $R_B$ which is approximately equal to that of the bottom of the bucket. Because there is an angle 76 between the plane 78 of the cutting edge of the cutter and the radial plane 80 which passes through the cutting edge of the cutter, however, the rotation of the rotor causes cutter 70 to produce a cut each radial section of which will have an elliptical shape. This elliptical (more precisely prolate elliptical) shape occurs because angle 76 foreshortens the horizontal dimension of the cutter without foreshortening the vertical dimension thereof. Thus, any radial cross section of the cut will comprise a section of a prolate ellipse, and any surface generated the revolution of the cut will comprise an equatorial section of a prolate ellipsoid. Both this ellipse and this ellipsoid will have a major axis that is aligned with the axis of the rotor.

Because the foreshortening produced by angle 76, the curvature of a radial section of the ellipsoidal surface will be less than that of a radial section of the bucket, which has a circular curvature determined by cutter curvature based on radius $R_C$. As a result, the bucket bottom will seat on the ellipsoidal surface with an orientation in which the plane through its pins is inclined slightly with respect to equatorial plane of the ellipsoidal surface, as shown in FIG. 7. Significantly, this seating orientation point is not affected by any initial imbalance in the loading of the bucket. As a result, the bucket will seat in the same position on the ellipsoidal surface, substantially without regard to any initial imbalance therein.

Because the above-described seating position causes the center of the bucket bottom to be located only slightly below horizontal plane 46, the accumulation of tolerances in various dimensions of the rotor can, in some cases, cause a bucket to seat with its pins still resting on the surfaces of their carrier assemblies. In order to prevent this from occurring, it may be desirable to shift the equatorial plane of the ellipsoidal surface upwardly (i.e., above plane 46) by a small amount, such as 10 to 20 thousandths of an inch. By shifting the equatorial plane by this distance, the space between the bucket pins and the surfaces of their carrier assemblies will be increased by the same distance, thereby preventing the accumulation of tolerances from causing side loading forces to be applied to the bucket pins. It is likely that it will be necessary to cut the desired shape of the seating surface with a form cutter having blades with elliptically shaped edges. Such edges preferably have a shape which will produce a seating surface which is the same as that described in connection with the hypothetical machining arrangement of FIG. 8.

While the present invention preferably contemplates embodiments such as that shown in FIG. 7 which have a seating surface that comprises an elliptical surface of revolution, it also contemplates embodiments which have a seating surface that comprises an elliptical surface of translation. The latter surface may be produced, with the last-mentioned form cutter, by properly positioning the cutter in a bucket opening and then translating the rotor in a straight line that is perpendicular to the radial center line of that opening. The resulting seating surface is analogous to that shown in FIGS. 1 and 6A, except that the seating surface has a radial cross section which is an ellipse rather than a straight line as in the existing art.

Because each seating surface of the existing art embodiment of FIG. 6A has no curvature in the horizontal plane, it cannot provide a bucket with supporting forces which are as widely distributed as those of the corresponding seating surface of the embodiment of FIG. 8. Instead, the seating surface of such embodiments will support a bucket at the four points which lie at the ends of lower edges **22*c* and 22*d* thereof. Because this four-point support is not as stable as that provided by the embodiment of FIG. 7**, embodiments which have seating surfaces comprising an elliptical surface of translation are not preferred over embodiments which have seating surfaces comprising elliptical surfaces of revolution.

In view of the foregoing it will be seen that a swinging bucket rotor constructed in accordance with the present invention provides a number of advantages over previously known swinging bucket rotors. Firstly, the rotor of the invention defines seating surfaces which, when used with carrier assemblies having springs with the proper spring constant, assure that each bucket first contacts the carrier ring with an orientation in which the centrifugal weight of the bucket acts above rather than below the contact point, thereby assuring that the buckets rotate in a position in which their pins are not subject to any side loading forces. Secondly, because the invention accomplishes this result by using a properly shaped seating surface, rather than by using an off center location for the bucket pins, it makes possible the use of symmetrical buckets thereby eliminating the risk that a bucket will be inserted with a reversed orientation. Finally, the present invention assures a seating position in which the bucket pins are not loaded, substantially without regard to any initial imbalances in the loading of the buckets.

What is claimed is:

1. A centrifuge rotor of the type having a plurality of carrier assemblies, a plurality of swinging buckets having pairs of bucket pins pivotally supported by respective carrier assemblies, a plurality of springs within the carrier assemblies for urging the bucket pins of respective buckets toward the center of the rotor, and a carrier ring having a plurality of bucket seating sites for supporting the bottoms of respective buckets when the rotor is spun at the desired speed, wherein:

(a) each bucket has a plane of symmetry through its bucket pins, and (b) each bucket seating site defines a seating surface having a shape which assures that, during seating, the respective bucket is rotated until its bucket pins lift slightly off of the surface of the respective carrier assembly, substantially without regard to any initial imbalance in the loading of the bucket.

2. The rotor of claim 1 in which the bottom of each bucket has a leading edge and a trailing edge, and in which the spring constant of each spring is such that the trailing edge of the respective bucket contacts the respective seating surface before the leading edge thereof.

3. The rotor of claim 1 in which each seating surface comprises a section of a surface of revolution formed by the revolution, about the axis of the rotor, of a line segment that is slightly inclined with respect to the axis of the rotor.

4. The rotor of claim 1 in which each seating surface comprises an equatorial section of a prolate ellipsoid having a major axis that substantially coincides with the axis of the rotor.

5. The rotor of claim 1 in each seating surface comprises a surface of translation generated by the translation of a section of a prolate ellipse having a major axis that substantially coincides with the axis of the rotor.

6. The rotor of claim 4 in which at least a part of the bottom of each bucket has a circular curvature.

7. The rotor of claim 4 in which the equatorial plane of the ellipsoid is located slightly above the plane defined by the centers of the bucket pins.

8. A centrifuge rotor of the type having a plurality of carrier assemblies, a plurality of swinging buckets having pairs of bucket pins pivotally supported by respective carrier assemblies, a plurality of springs within the carrier assemblies for urging the bucket pins of respective buckets toward the center of the rotor, and a carrier ring having a plurality of bucket seating sites for supporting the bottoms of respective buckets when the rotor is spun at the desired speed, wherein: each bucket seating site defines a seating surface having a curved shape which assures that a bucket coming into contact with the same has an orientation in which the centrifugal weight of the bucket acts at a point that is above the point of contact between the bucket and the seating surface, substantially without regard to any initial imbalance in the loading of the bucket.

9. The rotor of claim 8 in which each seating surface lies along the surface of revolution that is generated by the revolution about the axis of the rotor of a line that is inclined with respect to the plane defined by the centers of the bucket pins by an angle that is slightly greater than 90°.

10. The rotor of claim 8 in which each seating surface comprises a section of a prolate ellipsoid having a major axis that substantially coincides with the axis of the rotor.

11. The rotor of claim 9 in each seating surface lies along the surface of translation that is generated by the translation of an equatorial section of a prolate ellipse having a major axis that substantially coincides with the axis of the rotor.

12. The centrifuge rotor of claim 10 in which at least a part of the bottom of each bucket has a circular curvature.

13. The centrifuge rotor of claim 10 in which the equatorial plane of the ellipsoid is located slightly above the plane defined by the centers of the bucket pins.

* * * * *